US008635718B1

(12) United States Patent
Giagni, Sr. et al.

(10) Patent No.: US 8,635,718 B1
(45) Date of Patent: Jan. 28, 2014

(54) CONVERTIBLE SINK

(71) Applicants: Vincent A. Giagni, Sr., Purchase, NY (US); John D. Hyde, Flemington, NJ (US)

(72) Inventors: Vincent A. Giagni, Sr., Purchase, NY (US); John D. Hyde, Flemington, NJ (US)

( * ) Notice: Subject to any disclaimer, the term of this patent is extended or adjusted under 35 U.S.C. 154(b) by 0 days.

(21) Appl. No.: 13/815,393

(22) Filed: Feb. 28, 2013

(51) Int. Cl.
*A47K 3/14* (2006.01)

(52) U.S. Cl.
USPC ..... 4/514

(58) Field of Classification Search
USPC ..... 4/505, 514, 539, 640, 654
See application file for complete search history.

(56) References Cited

U.S. PATENT DOCUMENTS

| | | | | |
|---|---|---|---|---|
| 1,817,330 | A * | 8/1931 | Wilson, Jr. | 4/514 |
| 2,109,089 | A * | 2/1938 | Moyes | 4/514 |
| 4,333,188 | A * | 6/1982 | Jensen et al. | 4/514 |
| 7,721,362 | B2 * | 5/2010 | Martin et al. | 4/514 |

* cited by examiner

*Primary Examiner* — Huyen Le

(57) ABSTRACT

A single-bowl sink is converted into double-bowl sink by a specially designed divider plate placed across the inner walls of the sink. Each bowl (basin) has one drain hole for drainage of liquid and has top surface, a bottom surface and a pair of strips of ferrous metal attached to the bottom surface of the basin. The divider plate has an upper edge and a lower edge and a channel inside the lower edge, a permanent magnet in said channel for providing magnetic attraction between the divider plate and the strips of ferrous metal at the bottom surface of said basin and for maintaining the divider plate in position in said sink.

4 Claims, 4 Drawing Sheets

CONVERTIBLE SINK

FIELD OF THE INVENTION

The present invention relates generally to a convertible sink and is particularly related to a convertible kitchen sink of the type and variety used on countertops. More particularly, the present invention relates to a single-bowl kitchen sink incorporating a specially designed divider plate which converts a-single-bowl sink into a double bowl sink.

BACKGROUND OF THE INVENTION

Single bowl kitchen sinks have long been in use in various households for washing dishes and utensils. These sinks typically have a single basin, and a drain for drainage of the water. It is sometimes desirable and perhaps even necessary to avoid washing dishes and utensils in the same basin in one sink and hence it would be advantageous to use two separate basins within the same sink. One prior art patent, i.e., U.S. Pat. No. 4,333,138 issued Jun. 8, 1982 describes a sink which can be converted into one, two or more separate basins. A more recent patent, i.e., U.S. Pat. No. 7,721,362 issued May 26, 2010 describes a sink with removable divider and has an electromagnet positioned beneath the bottom surface of the sink which is attached to a ferrous material adjacent the bottom surface of the divider. The electromagnet is connected to an electrical power source which may be activated by a user or automatically by a sensor.

The devices of the prior art are either difficult to construct and use or, as in the case of the aforementioned more recent patent, require connection to residential electric power source.

It is therefore an object of the present invention to convert a single-bowl sink to a double-bowl sink more efficiently than have heretofore been disclosed by the prior art.

It is also an object of the present invention to convert a single-bowl sink to a double-bowl sink using a divider plate which is relatively simple in construction and does not require resort to connection to an electrical power source.

It is also an object of the present invention to convert a single-bowl sink to a double-bowl sink having different bowl sizes or basins.

The foregoing and other objects of this invention will be more clearly understood from the following detailed description and the accompanying drawings.

SUMMARY OF THE INVENTION

In accordance with this invention, a single-bowl sink is converted into a double-bowl sink by using a specially designed divider plate and interaction between a permanent magnetic element in the divider plate and a pair of ferrous metal strips attached to the bottom of the sink. The sink has a top edge surface, a basin with a drain and wall extending from the bottom of the basin to the top edge surface of the sink. The basin comprises a top surface and a bottom surface, and a pair of ferrous metal strips attached across the bottom surface of said basin. A divider plate which may be made from suitable materials is placed within the sink separating the drain holes and spanning across the sink. The divider plate is sized so that when it is placed in position in the sink it prevents the liquid from leaking from one basin to the other. A permanent magnet is placed in the lower edge of the divider plate which is held in place by the interaction of the permanent magnet in the divider plate and the strip of ferrous metal attached to the bottom surface of the basin.

In order to remove the divider plate from the sink, the top of the divider plate is tipped to one side thus providing leverage to separate the magnetic attraction between the permanent magnet in the divider plate and the strips of ferrous metal in the lower surface of the sink. The interruption of the magnetic force allows removal of the divider plate from the sink.

BRIEF DESCRIPTION OF THE DRAWINGS

In the drawings wherein like reference numerals refer to like parts.

DETAILED DESCRIPTION OF THE INVENTION

Figure 1:
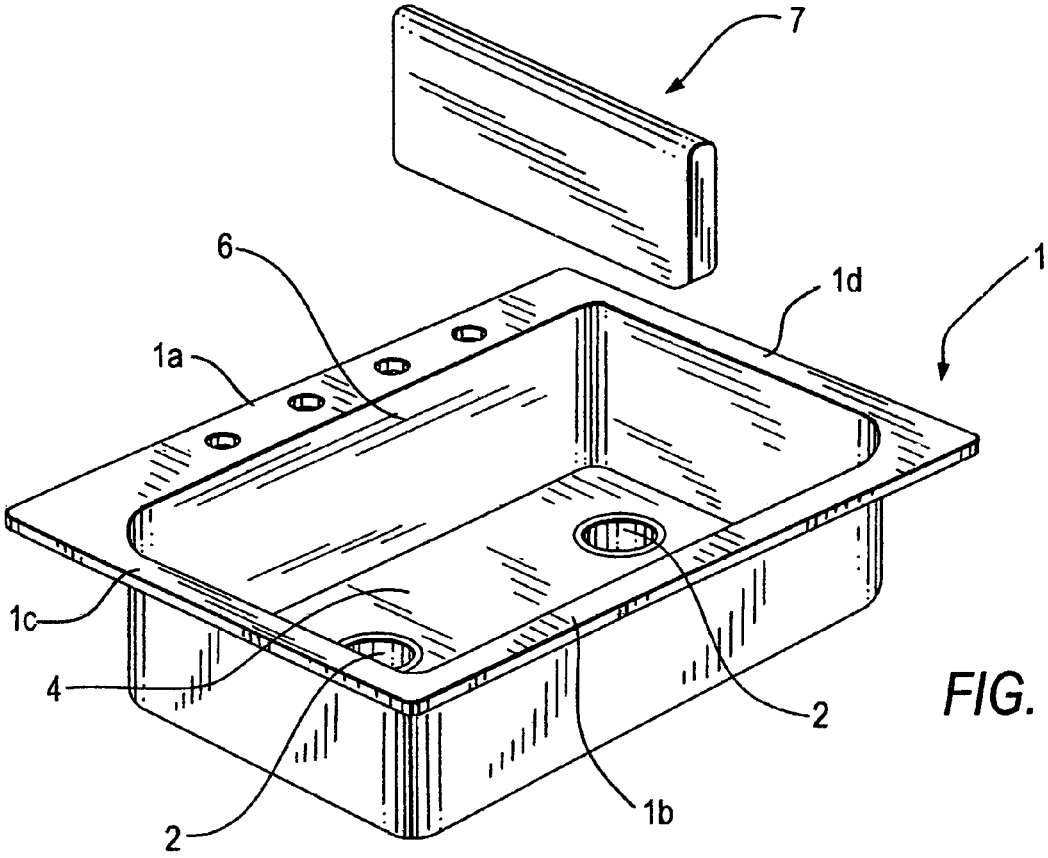
FIG. 1 is a perspective view of a sink having a single bowl with two drain holes.
Figure 2:
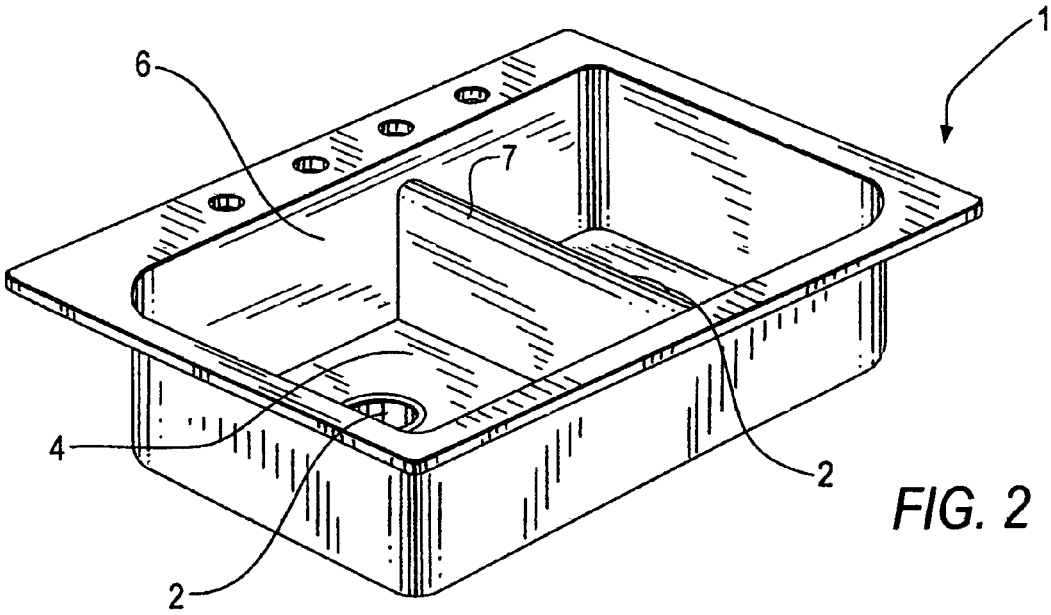
FIG. 2 is a perspective view of a sink as shown in FIG. 1 but with a divider plate which divides the single-bowl sink into a double-bowl sink.
Figure 3:
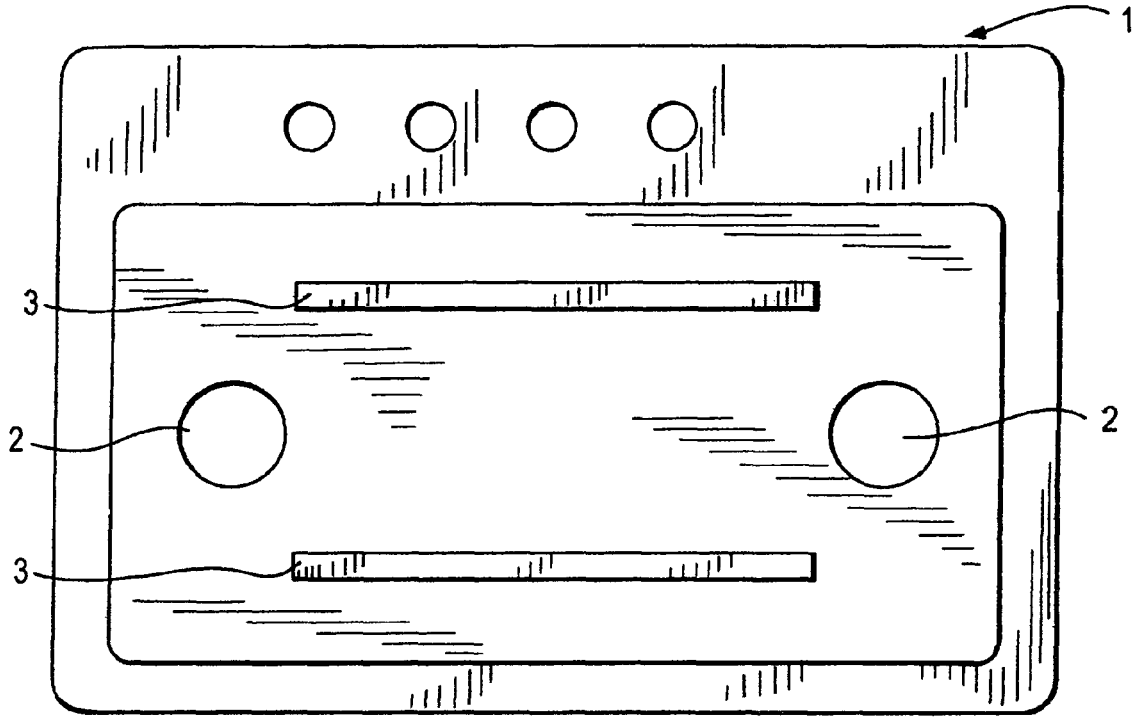
FIG. 3 is a plan bottom view of the sink shown in FIG. 2 with two ferrous metal strips attached to the bottom of the sink.
Figure 4:
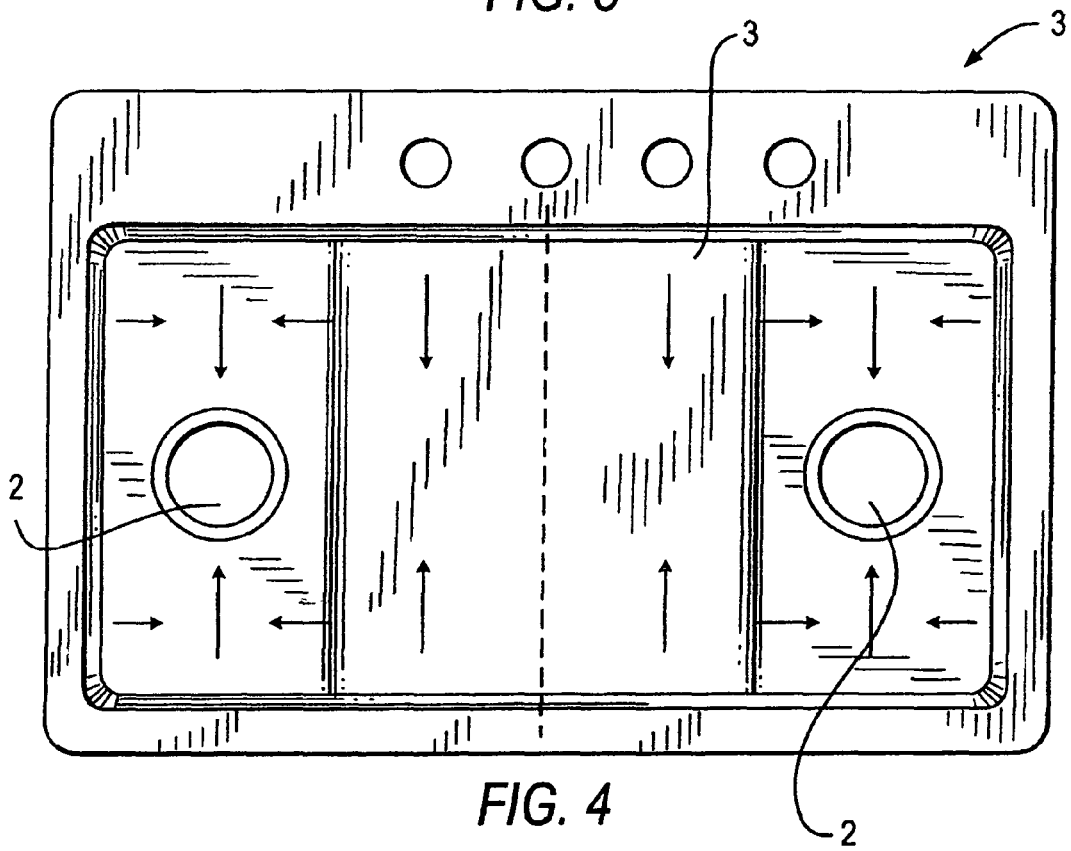
FIG. 4 is a plan view of the pitch pattern of the sump of the sink shown in FIG. 3 with arrows indicating the downward pitch direction toward the drain holes.
Figure 5:
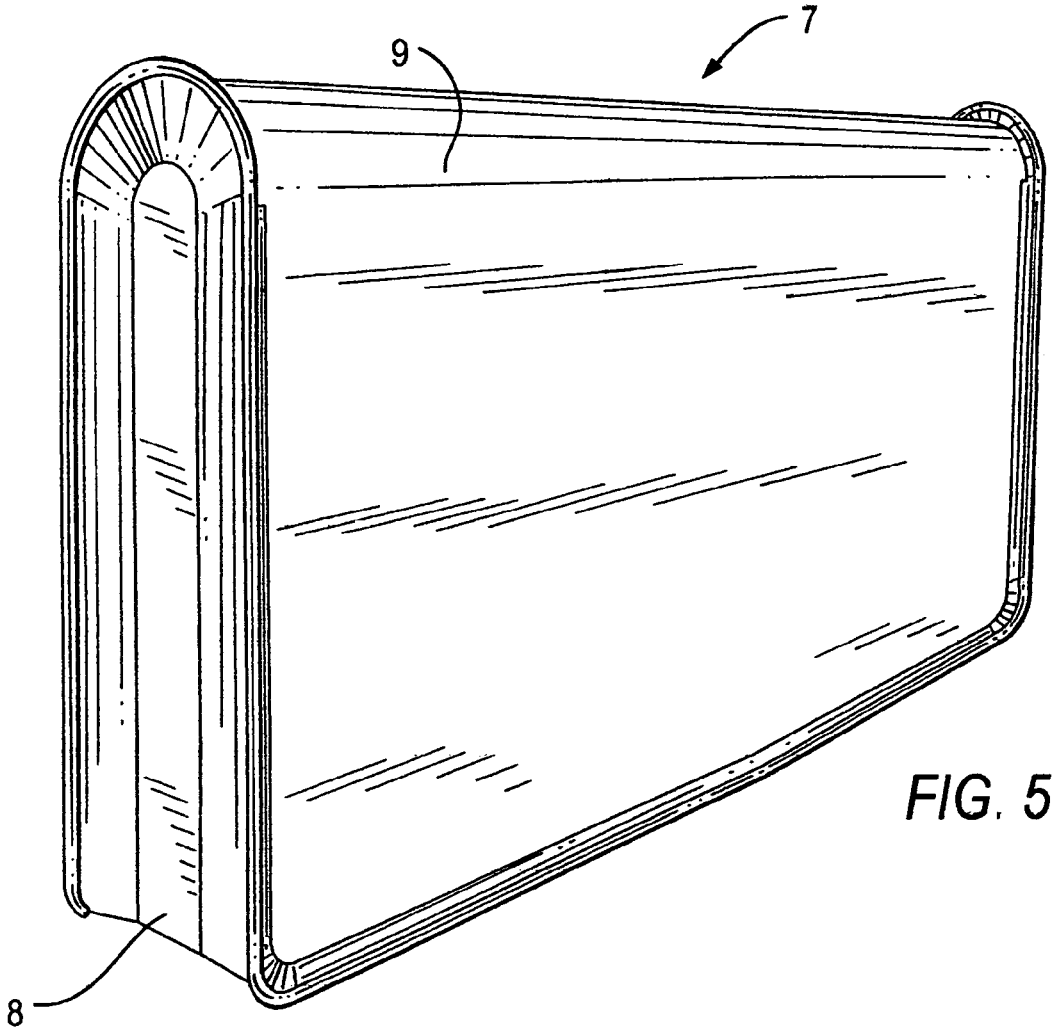
FIG. 5 is a partly perspective side elevational view of the divider plate used to divide the sink in accordance with the invention.

Referring first to FIGS. 1 and 2 of the drawings there are shown a sink 1 which may be made of stainless steel or other suitable material. The sink 1 has upper edge surfaces 1*a*, 1*b*, 1*c* and 1*d*, a sump or bowl 4, two drain holes 2 and walls extending from the bowl 4 to the edges 1*a*, 1*b*, 1*c* and 1*d*. The sump or bowl 4 is divided into two bowls by means of a divider plate (hereinafter also called divider) 7 which is placed inside the sink as hereinafter described. As shown in FIG. 2 the divider is placed in the middle of the sump 4 and hence it divides the sink into two bowls or sumps, however, the divider is adapted to be placed at different positions to create different size bowls as may be desired. The divider 7 is sized such that when it is placed in position within the sink it seals against the wall 6 and the sump 4 so that there is minimal or no leakage of liquid between the bowls. In FIG. 3, there is shown two spaced apart parallel strips 3 of ferrous metals which are suitably attached to the underneath surface of the sink. The ferrous metal strips 3 are magnetically attracted by and attach to strong permanent magnets 11 disposed within the frame 8 of the divider 7 as shown in FIGS. 6, 7 and 8.

Figure 6:
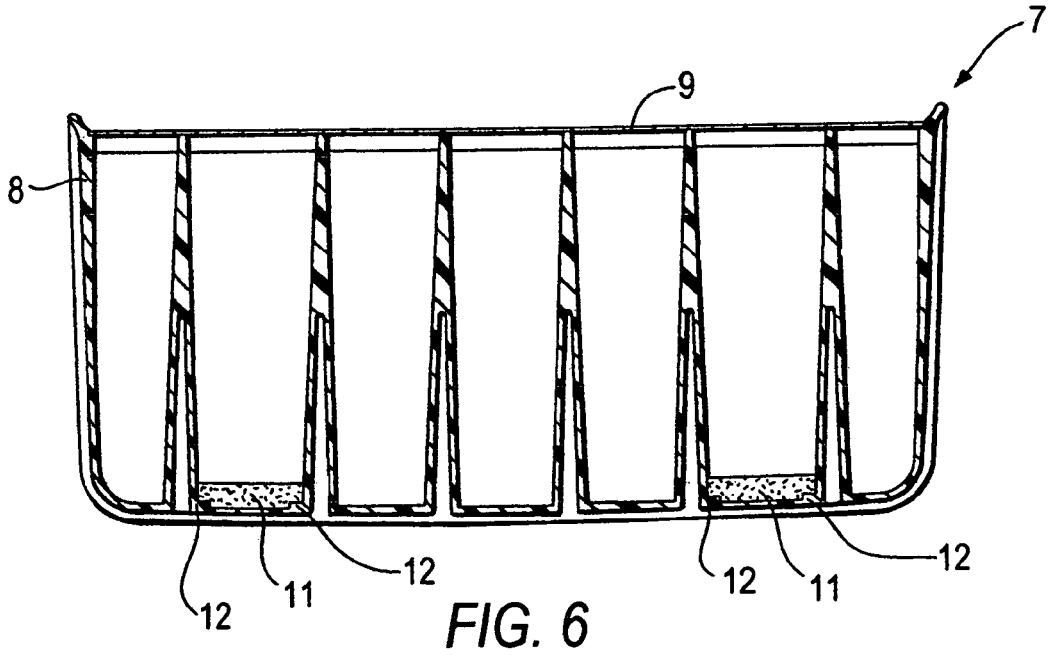
FIG. 6 is a longitudinal sectional side view of the divider plate illustrating the placement of the magnets inside the divider plate.
Figure 7:
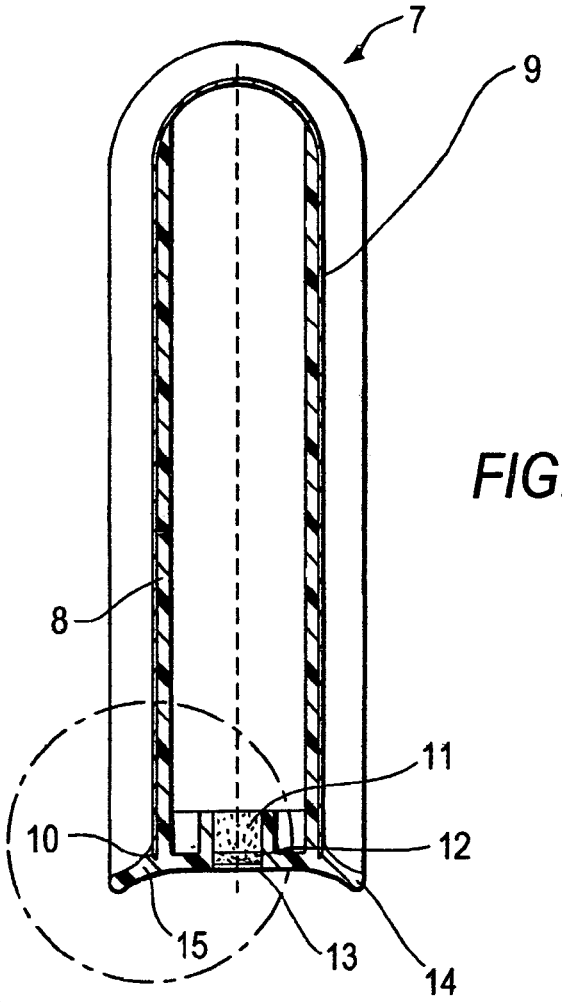
FIG. 7 is an elevational sectional view of the edge of the divider plate showing the placement of the magnets.
Figure 8:
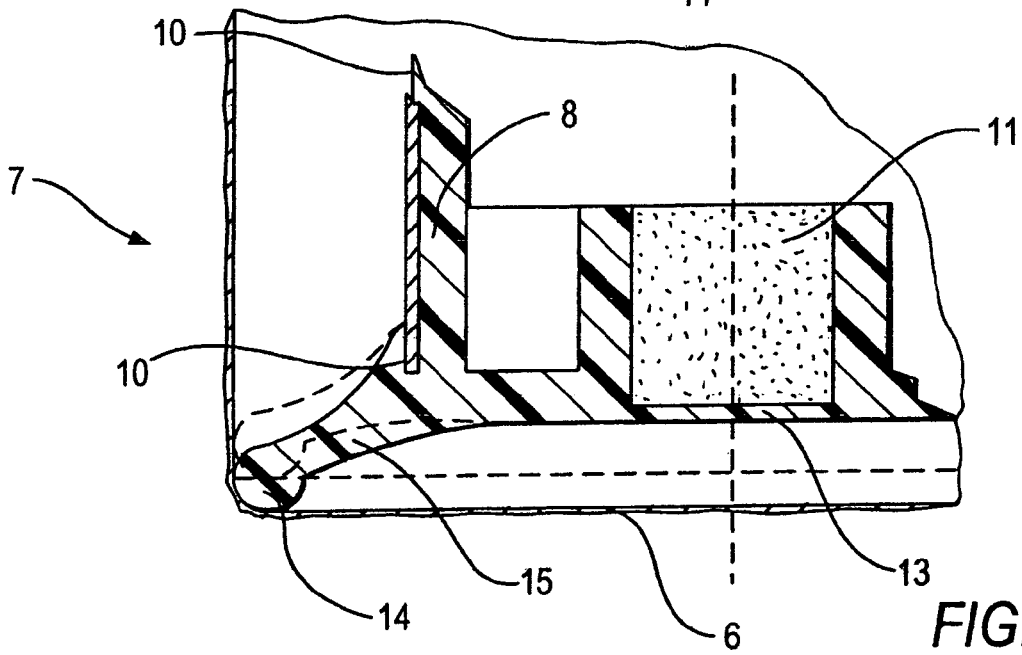
FIG. 8 is a detailed sectional view of the sealing surfaces and deflections within the dotted circle shown in FIG. 7.

FIGS. 6 and 7 illustrate different views of the divider 7. The divider may be constructed of a frame such as frame 8 and has a decorative shroud 9. The frame 8 may be constructed from a suitable plastic such as a medium durometer thermoplastic elastomer and the decorative shroud 9 may be made from a sheet of stainless steel, although these parts may be made from other suitable materials as well.

Referring to FIGS. 6 and 7, there is shown in FIG. 6 a pair of permanent magnets 11 which are press fitted into recesses within the frame 8 which has steps 12 in order to secure the magnets in their respective positions and prevent them from being displaced from the frame 8. A thin web 13 seals the magnets 11 without adversely affecting their magnetic property. A slot 10 (see FIGS. 7 and 8) secures the perimeter of the shroud 9 to the frame 8.

In order to divide the single bowl sink to a double bowl sink as shown in FIG. 2, the divider plate 7 is spanned across the width of the sink in the middle area of the sump 5 and the tapered sides of the divider are forced against the matching tapered sides of the inner wall 6 of the sink with enough interference to deflect the seal arms 15 and firmly press the seals 14 (see FIG. 8) against the sink wall. The magnetic attraction between the magnets 11 and the ferrous metal strips 3 is sufficient to maintain the divider 7 in contact with the sink. In order to remove the divider, the user can release the magnetic force by tilting the top of the divider 7 to create a fulcrum effect that causes sufficient separation between the magnets 11 and the ferrous metal strip 3 and thus permit removal of the divider 7 from the sink.

In accordance with the present invention, the sink may also be divided into unequal sized bowls by placing the divider 7 in different positions depending upon the respective sizes of the bowl. There is thus no need to use electrical power source in order to connect or disconnect the divider.

The invention claimed is:

1. A sink which can be divided into two adjacent open top compartments, each compartment defining a basin having a top surface, a bottom surface and upstanding walls, at least one drain hole in each compartment, a strip of ferrous metal attached to the bottom surface of said compartment, a divider plate placed across said sink for dividing said sink into said two compartments, said divider plate spanning the distance across the walls of said sink so as to prevent leakage of liquid between said compartments, a permanent magnet located within said divider plate such that said magnet interacts with said strip of ferrous metal to retain said divider plate in position.

2. A sink as in claim 1 made of stainless steel material.

3. A sink as in claim 1 wherein said basins are equal in size.

4. A sink as in claim 2 where said basins are equal in size.

* * * * *